United States Patent [19]

Reynolds et al.

[11] 4,089,373

[45] May 16, 1978

[54] SITU COAL COMBUSTION HEAT RECOVERY METHOD

[76] Inventors: Merrill J. Reynolds, 6111 E. Skelly Dr., Tulsa, Okla. 74135; Ralph W. Disney, 124 E. 4th St., Tulsa, Okla. 74103

[21] Appl. No.: 784,658

[22] Filed: Apr. 4, 1977

Related U.S. Application Data

[62] Division of Ser. No. 631,108, Nov. 12, 1975, Pat. No. 4,018,279.

[51] Int. Cl.[2] ..... E21B 43/24; F24J 3/00; F28D 21/00

[52] U.S. Cl. ..... 166/256; 165/45; 166/50; 166/52; 166/302

[58] Field of Search ..... 166/256–261, 166/272, 251, 302, 52, 303, 50; 165/45; 48/DIG. 6; 60/641

[56] References Cited

U.S. PATENT DOCUMENTS

| | | | |
|---|---|---|---|
| 3,294,167 | 12/1966 | Vogel | 166/280 X |
| 3,379,248 | 4/1968 | Strange | 166/256 |
| 3,924,680 | 12/1975 | Terry | 166/258 |
| 3,960,213 | 6/1976 | Striegler et al. | 166/50 X |
| 3,994,340 | 11/1976 | Anderson et al. | 166/50 X |

*Primary Examiner*—Stephen J. Novosad
*Attorney, Agent, or Firm*—Head, Johnson & Chafin

[57] ABSTRACT

A method for recovery of heat generated by the combustion of coal in situ within coal seams in the earth. Three embodiments are described: one, in which the coal seam crops out and into which can be drilled and inserted a pipe, through the coal seam, to a central point, where it is joined with a vertical pipe drilled from the surface. Water is supplied to the pipe at the point of outcrop. Fires are started within the coal seam and supplied with air from the surface by means of drilled boreholes. The heat of combustion converts the water in the pipe to steam which travels up the vertical pipe and is used to drive a turbine generator system. A second embodiment is used where there is an overlying aquifer above the coal seam. Fires are started by means of air supplied through boreholes leading from the surface into the coal seam. The heat of combustion converts the water in the aquifer to steam, which then is circulated out of the aquifer and up to the surface where it drives a turbine generator system. A third embodiment uses the hot combustion gases to heat water to steam in pipes in a vertical borehole.

6 Claims, 6 Drawing Figures

SITU COAL COMBUSTION HEAT RECOVERY METHOD

This is a divisional of application Ser. No. 631,108, filed Nov. 12, 1975, and now U.S. Pat. No. 4,018,279.

BACKGROUND OF THE INVENTION

1. Field of the Invention

This invention lies in the field of energy recovery. More particularly, it is concerned with the in situ combustion in shallow thin beds of coal, at shallow depths below the surface of the earth. Still more particularly, the invention lies in the field of the combustion of the coal by supplying air to the coal seam from the surface and utilizing the heat generated by the coal combustion to generate steam which is utilized at the surface of the ground, utilizing the earth (coal and surrounding rocks) as the furnace in the same manner as if it were geothermal.

In one application, this invention lies in the field of outcropping seams of coal where horizontal conduits can be drilled and placed within the coal seam to a specific point, where they join a vertical pipe. Water supplied to the horizontal pipes at the outcrop is heated within the pipes by the combustion of the coal around the pipes, and steam thus formed is carried up the vertical pipe to be used to drive a turbine generator system.

A still further application lies in the field of utilizing coal seams thin or thick, shallow or deep overlain by water sands or by hydrocarbon bearing formations whereby fires are started within the coal seam, and the heat of combustion is then communicated to the overlying aquifer or oil formation. If the overlying bed is an aquifer then steam will be formed which can be carried to the surface to drive an electric generator system. If the overlying bed contains viscous oil, then the heat will cause the oil to be reduced in viscosity sufficiently so that it can be driven by a steam drive, or by pumping water into the seam, which in view of the fire in the coal seam will turn to steam, which will drive the oil to the surface to be collected.

Still a further application involves the burning of coal in situ and carrying the hot gaseous products of combustion up a vertical borehole past a coiled pipe carrying water. Heat is transferred to the water by convection, forming steam which is carried to a turbine, etc.

2. Description of the Prior Art

Subsurface combustion of coal has been carried on in nature, by fires of unknown origin which were started many years ago and are burning continuously to the present date. Also oil companies, coal companies and government research laboratories have investigated many ways of underground combustion of coal, so as to utilize the products of combustion directly, as a coal gasification system. However, none of these methods have become practical as of the present date because of one or more basic difficulties.

SUMMARY OF THE INVENTION

It is a primary object of this invention to provide a rather specialized system for the utilization of the heat of in situ combustion of coal in shallow, thin, veins, seams or formations. The situations are specialized in that they are not generally applicable, but are applicable and are particularly useful in specialized areas, such as, for example, where the thin, shallow coal beds outcrop. The beds can be drilled and pipes inserted into the coal bed, in a more or less horizontal direction. Air holes can be supplied from the surface of the coal bed, on both sides of the horizontal pipes, so that combustion can be carried on along the position of the horizontal pipes. The horizontal pipes are supplied with water at the outcrop. The water will be heated and converted to steam, and can be carried to the surface through a vertical pipe drilled from the surface, and adapted to intersect the horizontal pipe or pipes. A plurality of such horizontal pipes can be directed in different directions, from the outcrop to a central vertical pipe, or the use of several vertical pipes can be used.

Another object of this invention is to provide a means for utilizing the heat resulting from the combustion of coal in situ in normally unminable coal veins, at a shallow depth below the surface. This is particularly useful where there is a water bearing formation directly above, and in contact with, the coal seam, or where there is a hydrocarbon bearing formation, where the oil is of such high viscosity that it cannot be produced by ordinary means. Here, by causing an artificial combustion, in situ, in the coal seam, the heat of combustion passes upward into the overlying aquafer and the water is heated and converted to steam, and is produced by one or more vertical pipes drilled into the water sand from the surface. The natural flow of water in the aquafer can replenish the water lost by steam, or additional vertical boreholes can be provided for the introduction of water under pressure into the aquafer.

If the overlying bed above the coal seam carries a very viscous oil, then the heat of combustion, after due course of time for the transmission of the heat vertically into the overlying formation, will cause the viscosity to be reduced to a point where it can be produced by gas drive or water drive. If water is used then there will be a combination of water and steam drive to force the oil, now of reduced viscosity, out through appropriate producing wells.

In a third embodiment, the hot gaseous products of combustion are carried to a vertical borehole in which is installed a coiled pipe, through which water is passed from the surface. The water is heated by heat transfer to the pipe from the hot gases as they flow up the borehole. The water is converted to steam which flows to a turbine, etc.

BRIEF DESCRIPTION OF THE DRAWINGS

These and other objects and advantages of this invention and a better understanding of the principles and details of the invention will be evident from the following description taken in conjunction with the appended drawings, in which.

DESCRIPTION OF THE PREFERRED EMBODIMENTS

Figure 1:
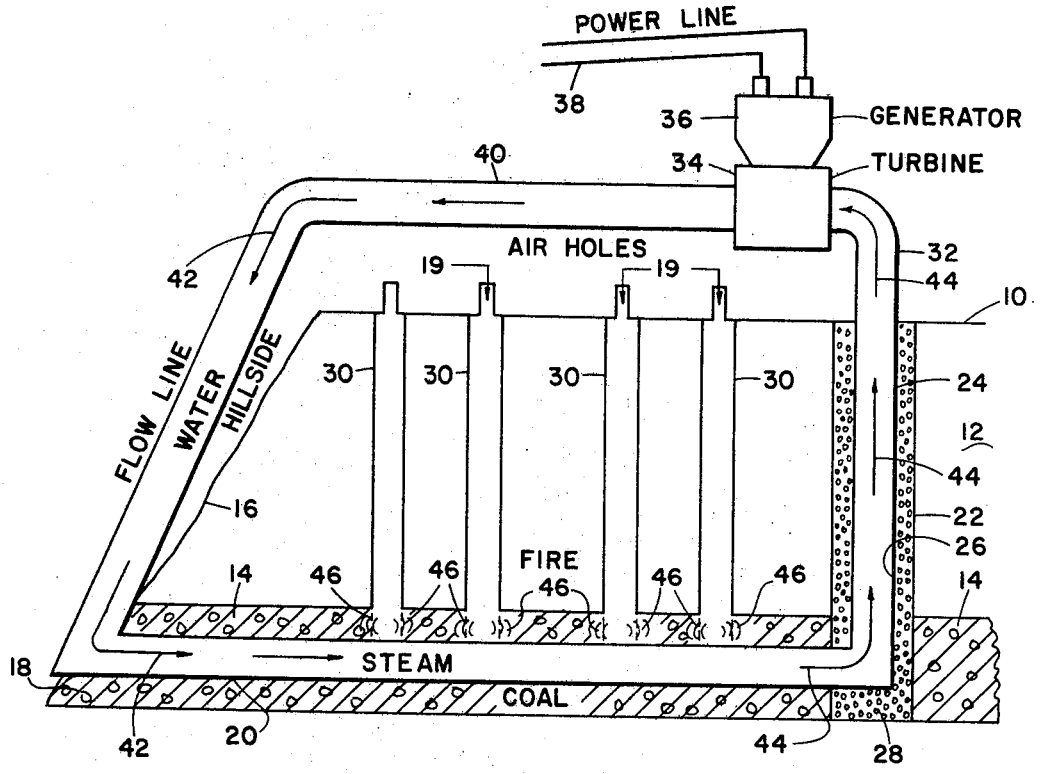
FIGS. 1 and 2 illustrate in vertical cross-section and plan views, one embodiment of this invention.
Figure 2:
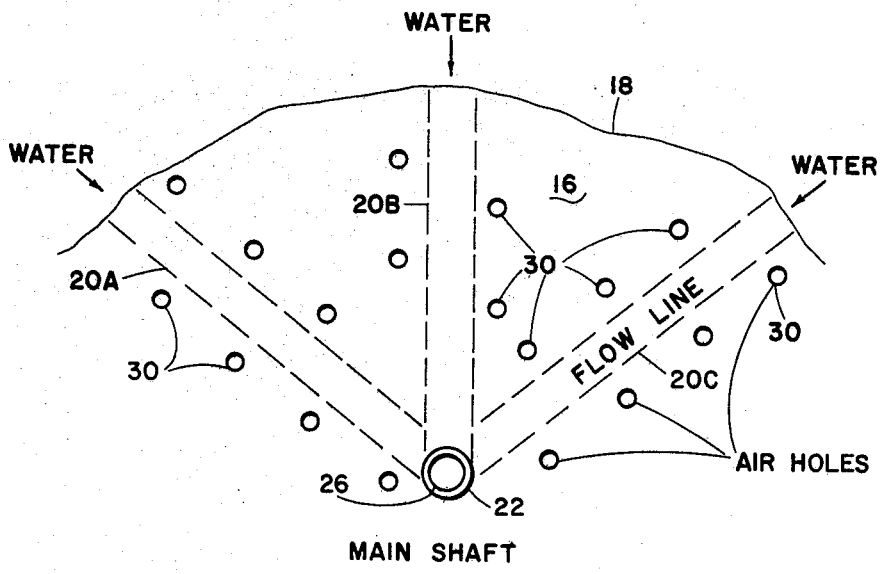

Referring now to the drawings, and in particular to FIGS. 1 and 2, there are shown two views of one embodiment of this invention. In FIG. 1 there is a vertical cross-section through the earth, showing the surface of the earth 10, an upper portion of the earth 12, resting on a thin, more or less horizontal seam or vein, of coal 14. Because of the surface topography, and the hillside 16, there will be an outcropping at 18 of the coal seam 14. Because of the availability of the outcrop 18, one or more horizontal boreholes 20 are drilled into the coal seam, parallel to the plane of the coal seam, to a selected point. There is a vertical borehole 22 drilled at said selected point, and a vertical pipe 26 is inserted into that borehole, and is cemented into place around the inner end of pipe 20, inserted into the horizontal borehole. This makes a continuous conduit from the outcrop 18, by means of the pipe or conduit 20 into the portion 28 of the borehole 22, and a pipe or casing 26 cemented around the inner end of the pipe 20 and around the vertical pipe 26.

The cementing of the joints between the horizontal and vertical pipes 20 and 26 in the region 28 permits the flow of water into the pipe 20 by means of a flow line 40 and arrows 42, for example, and the conversion of the water in the pipe 20 into steam in the region of the burning coal in the areas 46. The steam then flows along the pipe 20 and up the pipe 26 in accordance with arrows 44 to the surface where the steam is supplied to a turbine electric system 34, 36 and the power output of the generator goes by power line 38 to a point of application.

A plurality of vertical boreholes 30 are drilled from the surface down to, and into, the coal seam 14 in the vicinity of the horizontal pipes 20. As indicated by arrows 19 air is supplied under pressure to pipes within the boreholes 30, and the air passing down through the pipes into the coal seam maintain the combustion of the coal. The heat of combustion of the coal serves to convert the water in the pipe 20 into steam. The borehole 30 will generally be lined with casing which passes into and through the coal seam. The lower part of the casing will generally be perforated, or slotted, so as to permit the air to pass out into the coal area, but to prevent clinker and other products of the combustion of the coal, from stopping up the cross-section of the casing.

As shown in FIG. 2, plurality of horizontal bores 20A, 20B, 20C etc. and corresponding pipes in these bores, can be formed from different directions into or from the common vertical borehole 22 shown in FIG. 1. However, it is possible also to have a separate vertical borehole 22 and casing 26 for each of the horizontal pipes 20A, 20B, and 20C. The vertical air holes 30 are shown clustered around the position of the pipes 20 so as to completely burn all of the coal in the vicinity of the pipes.

When all of the coal has been burned in the region around one of the pipes, an additional bore 20, and corresponding pipe would be made in another portion of the coal seam where the coal has not yet been burned, so that the combustion can be carried out in the new area, to keep pace with the advance of the burning front. Of course, the original air holes can be used and/or additional air holes drilled as needed.

As shown in FIG. 1 no provision has been made for the passage out of the coal seam, of the products of combustion. If this becomes necessary, it may be desirable to drill one or more additional boreholes, for the passage of the products of combustion from the fires in the regions 46 to pass through the porosity of the coal into the outlet boreholes, to the surface, where the hot gases can be utilized in heat recovery devices, or boilers. If there are any unburned combustibles in the exit gases, they may be supplied, with the combustion air, in a boiler so as to utilize the further heat value of the products of combustion.

Figure 3:
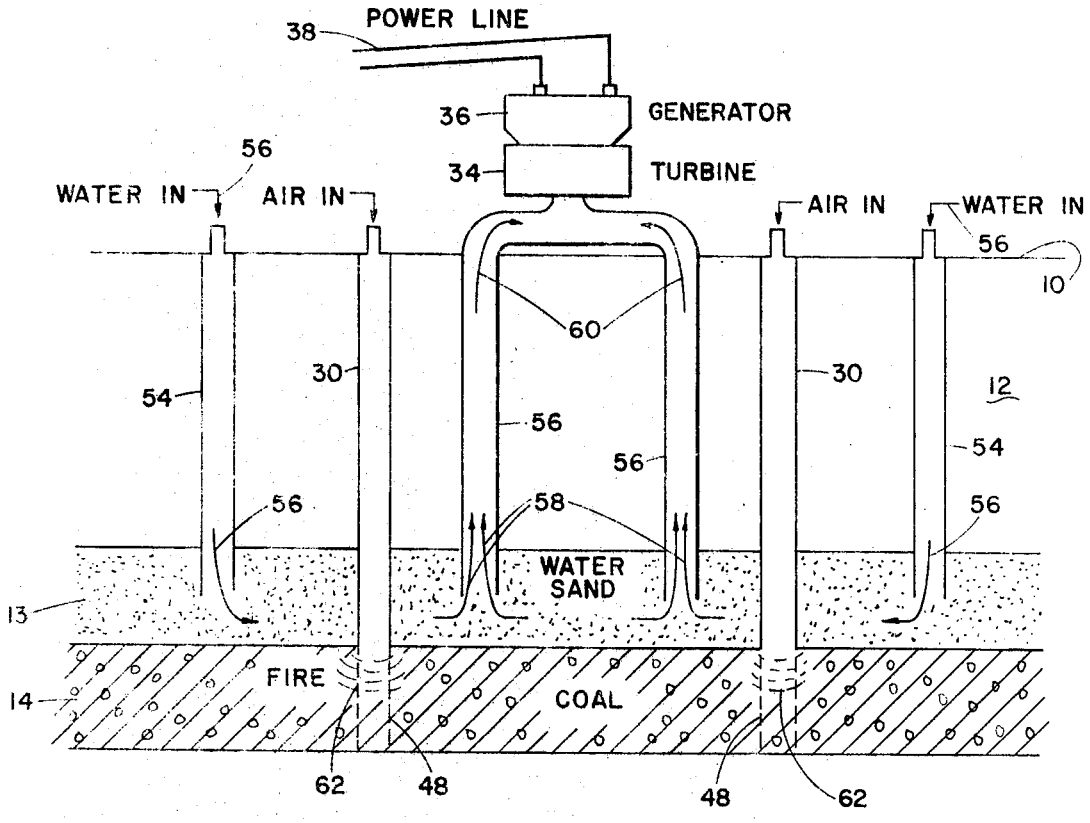
FIGS. 3 and 4 illustrate two views, in vertical section and in plan view, of a second embodiment of this invention.
Figure 4:
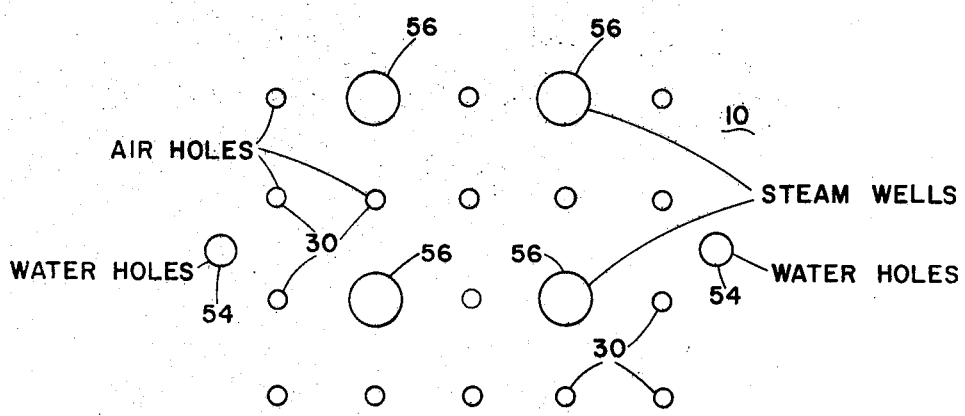

Referring now to FIGS. 3 and 4, there is shown a second embodiment of this invention which comprises a portion of the shallow surface of the earth containing a more or less horizontal coal seam 14 overlain by a porous water formation 13, and a portion of the earth 12 up to the surface 10. If the porous zone 13 contains water, then the combustion of the coal in bed 14 can serve to heat the water in the zone 13 to form steam, which can be utilized in a turbine, etc. For example, boreholes 30 are drilled from the surface down to, and into, the coal seam. The lower parts of the casing of these holes would be perforated or slotted for the passage of air down the casing and into the coal seam. The coal would be ignited by methods well-known in the art and combustion would be carried out within the coal seam 14. The heat of combustion would be communicated vertically to the overlying porous zone 13, which is filled with water. Because of the heat transmitted, the water would be converted to steam and steam would pass in accordance with arrows 58 from the porous sand 13, up one or more casings 56 drilled from the surface of the earth down into the water sand, and appropriately cased, so that the steam would pass upward and into a turbine 34 driving a generator 36 to provide power for delivery by the power line 38.

It may be desirable to provide additional cased holes 54 drilled from the surface down into the zone 13, to supply water under pressure, in accordance with arrows 56. This water would provide sufficient pressure in the water zone 13, to create enough back pressure to maintain a high pressure and steam, for efficient turbine operation. No detail is supplied as to the turbine generator and power system, since that art forms no part of this invention.

In FIG. 4 is shown a plan view of the surface 10 indicating a plurality of pipes 56 representing the pipes through which steam is supplied from the subsurface, to the turbine. Also shown are a plurality of spaced air bore holes 30 through which is supplied air for the combustion of the coal. In addition, pipes 54 are provided from the surface, to introduce water into the zone 13 to replenish the water supplied as steam to the turbine if necessary. Although not shown, it is possible to condense the steam issuing from the turbine and pump it back down into the formation 13 with the resulting conservation of water.

In FIG. 3, it is further considered that if an oil zone or an oil bearing formation 13 overlies the coal seam, and if the oil is of a viscous nature, which is not normally produceable, it is possible, where there is coal below the oil formation, to burn the coal, and by means of the heat of combustion, to heat the oil, and thereby reduce its viscosity, so that it can be pumped to the surface. One way of getting more fluid oil to the surface would be by means of pumping a gas down the pipes 54 to create a flow pressure on the oil toward the center of the field. The oil would then flow up the pipes 56. Of course, in the case of an oil formation the vertical pipes 56 would carry oil and would not be connected to a turbine generator system as shown.

It is also possible to force the flow of thinned oil to the producing pipes 56 by flowing water into the pipes 46 at the surface, and causing the water to convert to steam due to the heat provided by the burning coal. This steam would then provide a very effective sweeping or driving fluid to carry the oil into the central portion of the field and to the outlet pipes 56. In this type of situation, it may be desirable to surround the plurality of oil pipes 56 with a ring of input wells 54 arranged in a circle around the pipes 56, for the flow of drive fluid into the oil formation to drive the oil toward the center of the field.

Figure 5:
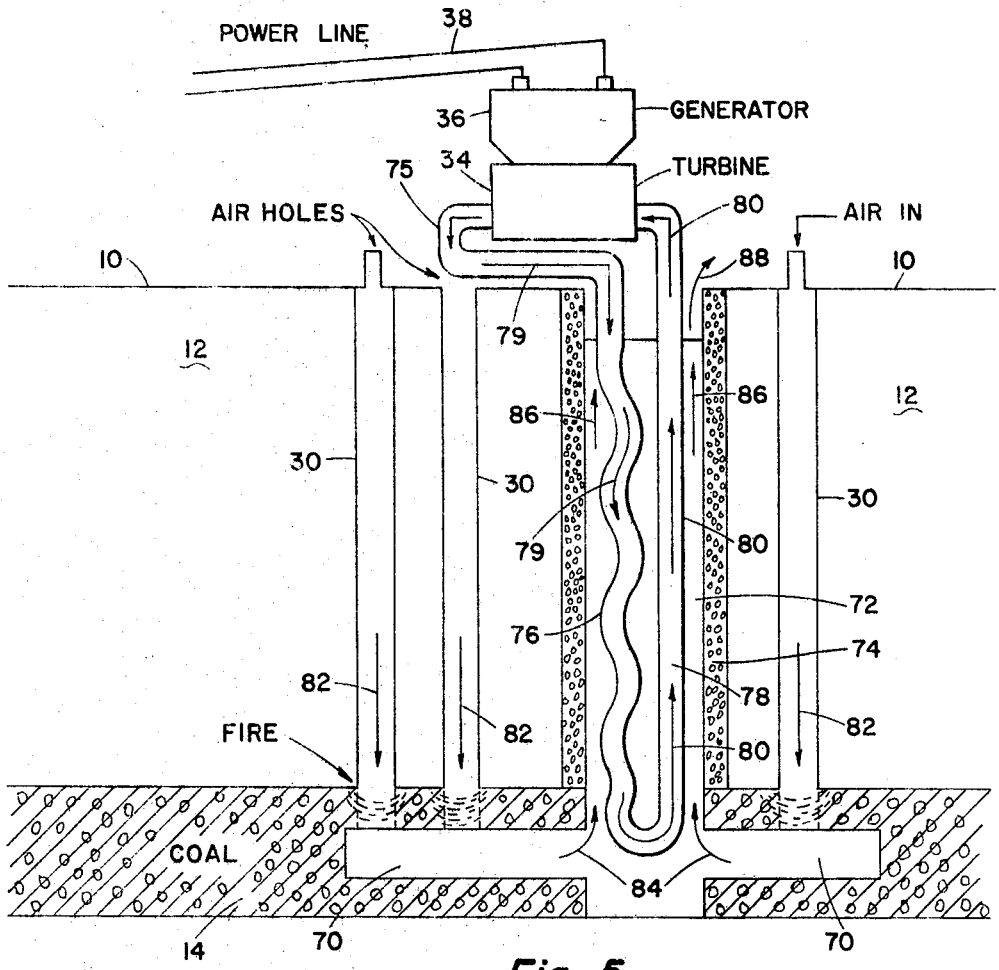
FIGS. 5 and 6 illustrate two views of a third embodiment.
Figure 6:
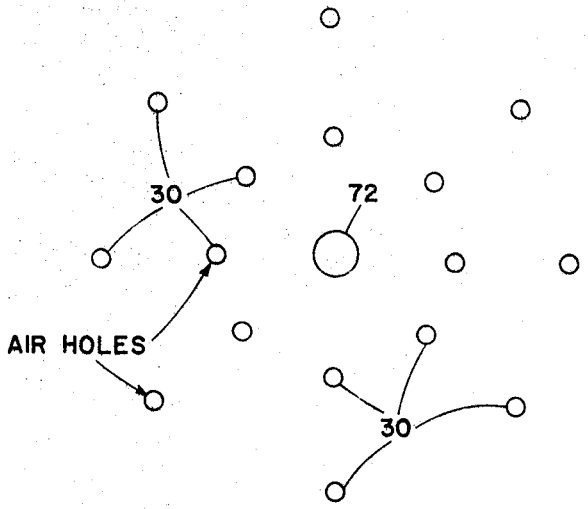

Referring now to FIGS. 5 and 6, there is shown a third embodiment of this invention in which there is a coal seam 14 at a selected depth in the earth. There are a plurality of vertical boreholes to which air is supplied under pressure 30 and which boreholes intersect the coal seam and the air flows in accordance with arrows 82 so that after the coal is ignited it will continue to burn and the hot products of combustion will pass through the pores of the coal seam and possibly through radial bores 70 to a central relatively large diameter vertical borehole 72. This will be cased or lined with concrete with cement as is customary. There is a continuous conduit which consists of pipe 75 which passes condensed steam from the turbine 34 in accordance with arrows 79 downward through a first pipe 76 which joins a second vertical pipe 78 at the bottom of the borehole. The condensed steam goes down as hot water through pipe 76 and is heated and passes upward in accordance with arrows 80 through the second pipe 78 in which the water is heated to steam and the steam then goes into the turbine 34 where it drives the turbine and the steam is then condensed and passes as hot water through the pipe 75 and back down into the borehole.

The hot product of combustion 84 pass up the borehole in accordance with arrows 84 and 86 and by convection heat the pipes 76 and 78 and thereby heat the liquid water inside the pipes turning the water into steam so as to drive the turbine.

The products of combustion 86 then vent at the surface end of the borehole and are utilized in any way that may be desired such as for example passing to a waste heat boiler for further utilization of the heat content of the products of combustion.

The down going pipe 76 is shown as a sinuous pipe. It will undoubtedly be advantageous to coil that pipe 76 possibly as helix surrounding the vertical pipe 78 thus providing a greater surface area of pipe for heat transfer from the upwardly flowing gases to the pipe and to the water inside the pipe. No further detail of the construction of these pipes is needed since this is a common type of situation where such as in the convection section of a heater where hot gases are passed over a plurality of pipes for heating a liquid in the pipe thereby recovering the waste heat that still remains in the products combustion just prior to their issuance through a stack to the atmosphere.

This embodiment as shown in FIGS. 5 and 6 is different from either of the other two body embodiments shown in FIGS. 1 and 2 and in FIGS. 3 and 4. In the former the pipe containing the water passes through the zone where the coal is actually being burned and is therefore in a hotter environment and therefore there is a greater rate of heat transfer. In the embodiment shown in FIGS. 3 and 4, the water is in a planar contact over the surface of the coal seam and heat is transferred from the hot coal into the water sand and from there to the water where it is converted to steam which passes to the turbine. Here in this embodiment the combustion of the coal provides a continuous stream of products combustion which flows from the points of air inlet 82 through the burning zone and through a volume either drilled or otherwise formed 70 or through porous regions which have previously been burned. The hot products of hot gases which are products of the combustion then pass out through the borehole and deliver their heat to the pipes 76 and 78 by convection and then pass out to the atmosphere or to some other heat recovery means such as is well known in the art.

FIG. 6 shows in planned view the spacial arrangement of the air holes in a pattern surrounding the central bore holes 72.

Other elements of FIG. 5, which have not been specifically described, are similar to the corresponding elements having the same numbers in FIGS. 1 and 3 and therefore need no further description.

No detail has been provided on the methods or apparatus required for drilling the horizontal and vertical boreholes, and for setting casing, etc. since all of this art is well-known in the oil industry. While we have talked of "more or less" horizontal coal seams, it will be clear that the coal seams can be tilted to any angle of dip in which they may be found. It may be valuable in that case to design the drilling of the pipes and the air holes in such a direction as to take advantage of the dip of the coal seam.

While it is old in the art, to generally burn coal in situ in the earth, and to recover its products of combustion, we have invented particular embodiments which utilize the geological environments in which:

(a) the coal seam crops out, and
(b) where the coal seam is overlain by either a water formation or a formation containing very viscous oil, which normally cannot be produced except by being heated and then driven through the formation.

Although the physical requirements of these two embodiments are rather specific, they do have considerable advantage in that:

(a) they eliminate the mining of the coal which would be unprofitable, particularly for thin seams;
(b) they eliminate waste in the mining of coal;
(c) they eliminate the dust pollution, etc.;
(d) they eliminate the transportation of coal;
(e) they can recover all available energy and usuable gases;
(f) the methods are applicable to any depth of the coal seam, although the economics would indicate that they are best for relatively shallow coal seams;
(g) they can utilize thin coal seams that would never be mined;
(h) the burning of the coal can be regulated by the amount of air pumped to obtain all the energy that can be captured with the described facilities;
(i) the energy can be transmitted as electrical energy, the cheapest form of energy transportation.

While the invention has been described with a certain degree of particularity it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed:

1. In a coal seam in the earth, the method of burning the coal in situ and recovering the heat of combustion, comprising:

(a) forming at least one horizontal borehole into said seam, substantially parallel to the plane of said seam, to a selected point, and inserting a first casing into said one horizontal borehole;

(b) forming from the surface at least one first vertical borehole to intersect said one horizontal borehole at said selected point, and inserting a second casing into said one first vertical borehole, and joining said first and second casings;

(c) forming a plurality of horizontally spaced second vertical boreholes from the surface into said coal seam in the area of said one horizontal borehole, and supplying air under pressure through said boreholes to said coal seam.

(d) igniting said coal in the vicinity of said air boreholes and continuously burning said coal;

(e) flowing water into said first casing, whereby said water will be converted to steam, and will flow up said second casing; and (f) flowing said steam into a steam power utilization means.

2. The method as in claim 1 including the additional steps of drilling a plurality of horizontal boreholes to said selected point, inserting a plurality of first casings, and joining said first casings to said second casings.

3. The method as in claim 2 including the steps of drilling a plurality of vertical boreholes at a multiplicity of selected points, placing second casings in each vertical borehole, and joining each second casing to one of said first casings.

4. The method as in claim 3 including the steps of supplying water to each of said first casings and utilizing the steam produced at said second casings.

5. The method as in claim 1 including the additional steps of:

(g) drilling at least one third vertical borehole from the surface into said coal seam in the area of said second vertical boreholes, whereby the products of combustion of said coal will flow up said third vertical borehole to the surface; and (h) utilizing said products of combustion.

6. The method of claim 1 wherein said coal seam crops out and said horizontal borehole extends from said outcrop into said seam.

* * * * *